US005766040A

United States Patent [19]

Naerland et al.

[11] Patent Number: 5,766,040

[45] Date of Patent: Jun. 16, 1998

[54] CONTACT SET FOR TWISTED PAIR CABLE WITH INDIVIDUALLY SHIELDED PAIRS

[75] Inventors: Geir Naerland; Øystein Weum, both of Asker, Norway

[73] Assignee: Telesafe AS, Asker, Norway

[21] Appl. No.: 684,051

[22] Filed: Jul. 22, 1996

[30] Foreign Application Priority Data

Feb. 29, 1996 [NO] Norway ..... 960840

[51] Int. Cl.[6] ..... H01R 13/648

[52] U.S. Cl. ..... 439/608; 439/678

[58] Field of Search ..... 439/607, 608, 439/609, 610, 678

[56] References Cited

U.S. PATENT DOCUMENTS 5,057,038 10/1991 Bowen et al. ..... 439/608

5,433,618 7/1995 Morlion et al. ..... 439/608

*Primary Examiner*—Khiem Nguyen

*Assistant Examiner*—Yong Ki Kim

*Attorney, Agent, or Firm*—Wenderoth, Lind & Ponack

[57] ABSTRACT

A contact set for broadband communication pair cable consists of two mating connectors, namely a plug containing contact pins (3) and a jack containing contact receptacles (13). One of the two connectors is a cable-mounted connector, while the other connector may be a fixed-mount connector, e.g. a printed circuit board connector, or a cable-mount connector. Inside a metallic shield cover (7) pairs of contact pins (3) or pairs of receptacles (13) are arranged with a 90° twist in relation to a nearest neighbour pair to avoid magnetic coupling between pairs. The shielding between cable pairs is completed throughout the contact set by means of a metallic shield kernel member (11, 1) in at least one of the connectors and inwardly folded metallic contact springs (10) in an opposite connector, for engagement between at least one kernel member (11, 1) and the contact springs (10) in a mated situation.

20 Claims, 12 Drawing Sheets

CONTACT SET FOR TWISTED PAIR CABLE WITH INDIVIDUALLY SHIELDED PAIRS

BACKGROUND OF THE INVENTION

The present invention relates to a contact set which comprises a female contact part and a male contact part, to be used in connection with multi-pair cables with individually shielded pairs. The contact set of the invention may provide a coupling from a multi-pair shielded pair cable to a printed circuit board (PCS), or a coupling between two cable parts. The contact set is suited to be employed as part of a wideband communications equipment.

The continuous development of data communications has created a demand for the transmission of higher and higher data rates. For local transmissions, most commonly used today is twisted pair cable (TP). A highly cost efficient medium, TP has evolved from being almost exclusively a transmission medium for telephony to a medium capable of handling data communications with bandwidth requirements of 100 MHz or more.

Cabling systems based on TP are standardized internationally for bandwidths up to 100 MHz. These standards define the quality requirements for both cable and connecting hardware. To a large extent, the connector used is the RJ45 connector, designed for use with a four pair cable. In Europe, the standardization body Cenelec has defined the cable and connector requirements, mainly through the norm EN 50173. The RJ45 connector is standardized both with respect to design and to electrical performance.

Above 100 MHz, TP has not been standardized. Some cable manufacturers, however, have started the marketing of cables capable of transmitting signals with frequencies up to at least 300 MHz. In some cases, 600 MHz appears feasible. In order to reduce crosstalk between neighboring pairs, the cable uses an aluminum foil screen around each pair. In addition, the cable often has an overall braided screen. When used with data equipment, the combined foil and braid screens give the cable excellent immunity against external electromagnetic disturbances and a low level of emission (EMC).

Correspondingly, connecting hardware for frequencies above 100 MHz has not been standardized. The RJ45 connector can possibly be improved, but in any case a limit will be found around 2–300 MHz, where the crosstalk between the contact pins—pair vs. pair—becomes too high.

IBM has marketed a cabling system claiming usable performance up to 300 MHz. The system uses a set of connectors called "MiniC". However, the manner in which the contact springs are designed and arranged inside the connectors, and the manner in which the shield is designed around each set of two contact pins, limit the use of these connectors to a range below about 300 MHz.

OBJECT OF THE INVENTION

Thus, the object of the present invention is to provide a contact set which overcomes the above limitations, and which provides good transmission characteristics up to and possibly beyond 600 MHz.

BRIEF DESCRIPTION OF THE DRAWING

The invention will now be explained in more detail by reference to embodiments thereof, shown in the appended drawings, where.

Figure 1A:
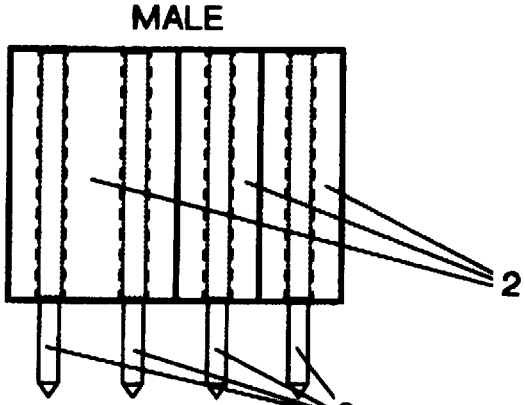
FIGS. 1A–1D show the geometrical layout of contact pins and contact receptacles in respectively male and female connectors in a cable splicing embodiment of the contact set in accordance with the invention.
Figure 1B:
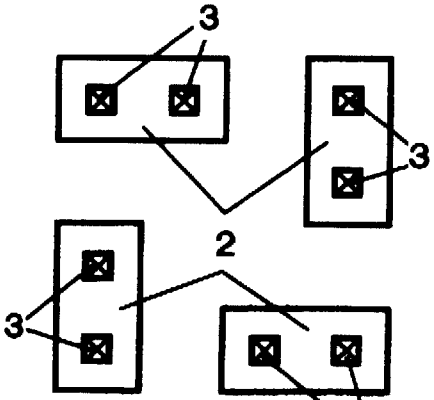
Figure 1C:
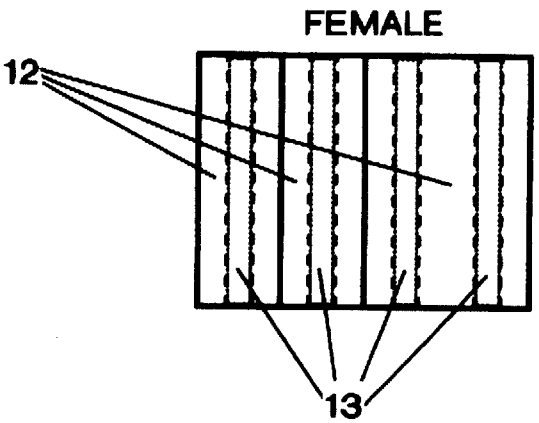
Figure 1D:
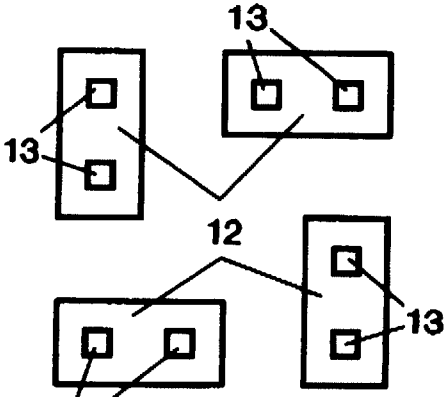

The contact set of the invention consists essentially of a male connector or plug containing contact pins, and a female connector or jack containing contact receptacles intended for direct engagement or mating with the contact pins. Thus "pins" dictate a "plug" type connector, and "receptacles" define a "jack" type connector, even if surrounding shield covers may be arranged in such a manner that the shield cover of a "plug/male connector" actually receives the shield cover of a "jack/female connector" for inside mating.

The contact set has two general aspects, namely the aspect of providing a connection between a multi-pair pair cable and a printed circuit board (PCB) (or more generally, a fixed electrical assembly), and the aspect of providing a connection between two such pair cables. The first aspect can be divided into two specific embodiments, namely (a) one in which one of the connectors in the contact set is a PCB-mounted plug with pins soldered directly to the board, while the other connector is a cable-mounted jack having contact receptacles. The second embodiment of the first aspect includes (b) a PCB-mounted jack with receptacles soldered directly to the board, while the other connector is a cable-mounted plug having contact pins.

The second aspect, i.e. the cable-to-cable aspect, branches off into four separate embodiments: One single cable connector may be I) a male connector having a "male" type shield cover II) a male connector having a "female" type shield cover III) a female connector having a "female" type shield cover, and IV) a female connector having a "male" type shield cover.

Of course type I can mate with only type III, and type II must mate with type IV.

Further, a cable having a type I connector must be used to mate with a PCB connector of type (b) (see above), and a cable with a type IV connector must mate with a type (a) PCB connector. Regarding the PCB connector, one does not include as a favourable embodiment the embodiment with a "male" type shield cover, the "female" type shield cover is preferable for a PCB-mounted connector. However, in its most general form, the invention will also include the option of a "male" type shield cover for a PCB connector.

Further, in the following detailed description, the embodiment most often referred to is an embodiment having a square-shaped shield cover cross section, i.e. as appearing e.g. in the lower part of FIG. 4, but it should be realized that the cross section may in general be rectangular, plural-edged or even having curved outer boundaries. Nor is it a prerequisite that the connectors contain exactly four pairs of contact pins or contact receptacles, any number of pairs from 2 and up is encompassed by the invention. The essential points are (i) a specified mutual geometrical layout of the pairs inside a connector, and (ii) the presence of inter-pair shielding as specified further herebelow, by means of at least one shield kernel member and springy metal tongues.

Referring now to FIG. 1 of the appended drawings, this figure shows the principal layout of essential parts of an embodiment of a cable plug and a cable jack in accordance with the invention. As mentioned above, this embodiment is a 4-pair quadratic embodiment.

The left side part of FIG. 1 shows a cable plug layout. The bottom drawing contains in a front view four pairs of parallel contact pins 3, the pins pointing right out of the paper plane. The contact pins 3 are inserted two by two in insulating holder parts 2, preferably made of a plastic material. In the embodiment shown, each such holder 2 has the shape of a right-angled parallelepiped. However, this holder shape is particularly adapted for the 4-pair quadratic embodiment, and other shapes may be opportune in other embodiments, e.g. a curved shape on one side may give a better fit to a surrounding structure (shield cover, see below) in some embodiments.

The top left drawing shows the same parts as the bottom drawing, however in a side view. It appears that the pins 3 project below (or more correctly, forwardly of) the plastic holders 2.

One very important feature of the invention appears already in this drawing, namely the geometrical configuration of pin pairs. Each pair of contact pins is arranged at a 90° angle relative to the nearest pair or both nearest pairs. (To be more specific, the orientation of each pair, where "orientation" is defined as the direction associated with the spacing between single pins in a pair of parallel pins, is turned 90° from one pair to the next-neighbour pair.)

The right side part of FIG. 1 shows the layout of corresponding parts in a cable jack or female connector, i.e. corresponding to the layout for the plug parts shown on the left side of the drawing. In the lower drawing appear, in a front view, four pairs of parallel contact receptacles 13, geometrically arranged in a similar manner as the contact pins 3 in the plug on the left. The receptacles 13 are mounted in separate insulating holder parts 12, preferably plastic holders. The same arrangement is shown in a side view in the top right drawing.

Each wire of the pair cable (in this embodiment a four-pair cable) is attached to the rear end of a contact pin 3 or a contact receptacle 13 by soldering, displacement or by crimp. Pins and receptacles can be commercially available products, and they are usually gold plated. The receptacles 13 preferably rely on some sort of spring action in order to secure good electrical contact when interfaced with the pins. The receptacles thus may be shaped as elongate, open-ended cylinders with a split along the length thereof, or as similar cylinders with an internal spring part. The pins 3 are preferably solid, elongate cylinders or hollow cylinders.

As mentioned above, the "orientation twist" from one pin pair/receptacle pair to the neighbour pair constitutes an important characteristic of the invention. This characteristic contributes strongly to keep the crosstalk between the pairs low, in particular because the coupling due to magnetic fields is minimized.

Continuing with a description of the same specific embodiment of a cable splicing contact set comprising a cable plug and a cable jack, it is now referred to FIG. 3: The left side of FIG. 3 shows a metallic or highly conductive body 2 which forms a shield kernel member to be placed inside a plug/male connector exhibiting the arrangement appearing in FIG. 1, left part. The forward part of the kernel member 1 has a cross section such as appears in the lower left drawing, however, the excact shape of the kernel member is only of top importance as far as concerns the necessity of the existence of a metallic kernel member inbetween the pin pairs shown in FIG. 1. The specific shape shown in FIG. 3 has been chosen so as to be adapted to the specific pin holders 2 arranged as shown in FIG. 1, i.e. the kernel member fits rather exactly in-between the plastic holders, having a cross section shaped as a "disaligned cross".

The pyramidal shape in the rear part of the kernel member 1, tapering off to a point 4, is chosen to provide guidance and support for the cable pairs from a point of entrance into a plug, near said point 4, and forward to the rear end of each separate pin in the plug. This shape is not paramount to the invention, but represents a preferred embodiment.

The kernel member 1 is preferably made from a solid piece of metal, preferably copper, aluminum or zinc, and preferably with a tinned surface. In the right side part of FIG. 3 appears a quite similar shield member 11 for the corresponding cable jack/female connector. All statements regarding kernel member 1 have corresponding statements regarding kernel member 11.

In FIG. 4 are shown arrangements of plastic holder parts 2 and 12 around each kernel member 1 and 11, actually in corners of the above mentioned "disaligned cross" of the kernel members 1 and 11. The holder parts may be kept in position (e.g. while assembling a connector) for instance by small cavities in the kernel member (not shown in the drawings) and corresponding "bulbs" on the holder parts.

Figure 5B:
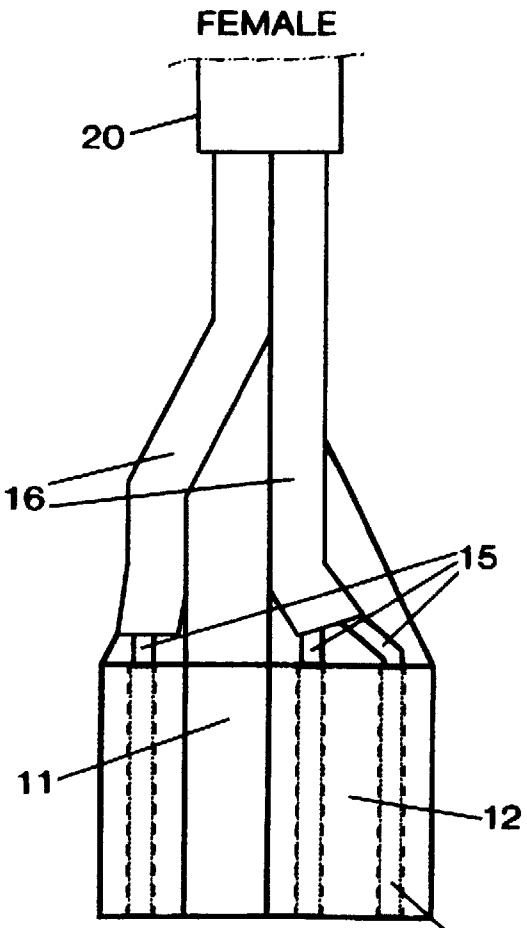
Figure 5A:
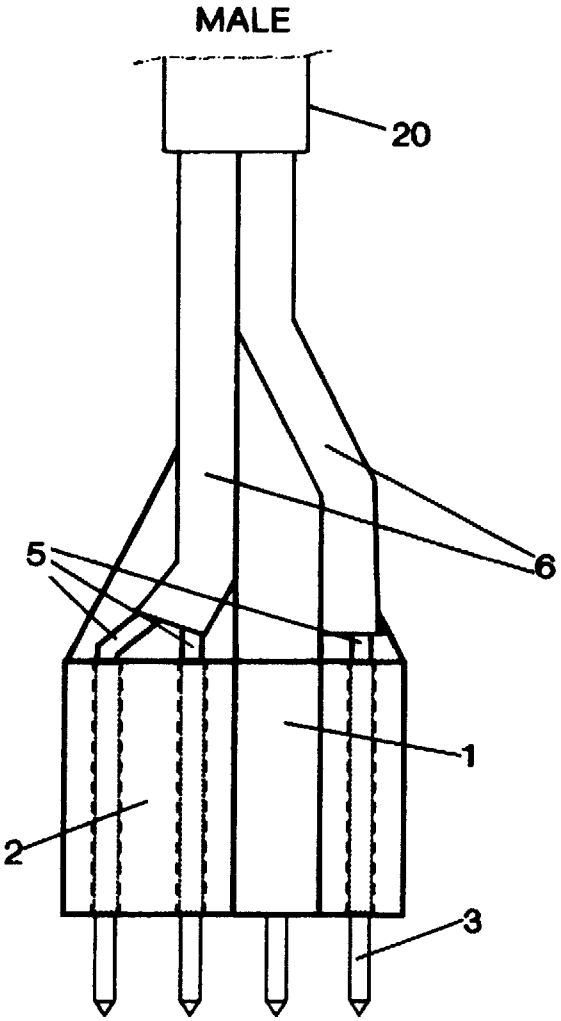

FIG. 5 shows a preferred connection configuration of cable pairs to respectively pins 3 and receptacles 13 for a cable splicing contact set. It appears clearly that FIG. 5 represents a continuation of FIGS. 1, 3 and 4. The connections are made by crimp, displacements or soldering techniques. As previously mentioned, the pyramidal prolongation of the kernel members acts as a guide for the cable pairs 5 and 15, and also secures good electrical contact between the kernel members 1, 11 and the (metallic) foil screens 6 and 16 surrounding each cable pair. These guiding/support features are important and preferred additional features of the invention. Reference numeral 20 designates an overall (metallic) cable screen.

Figure 6B:
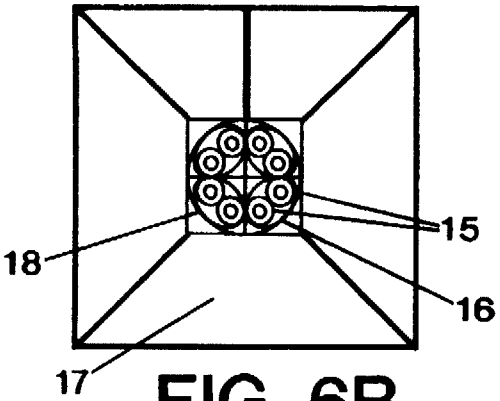
Figure 6C:
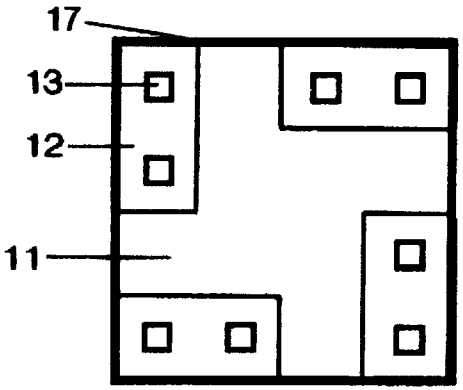
Figure 6A:
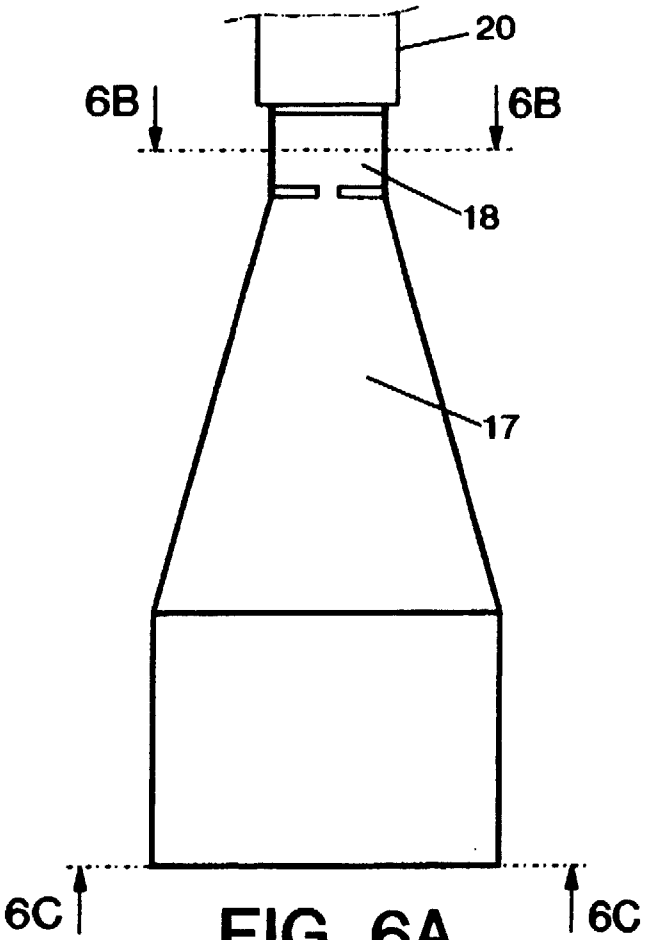
Figure 7B:
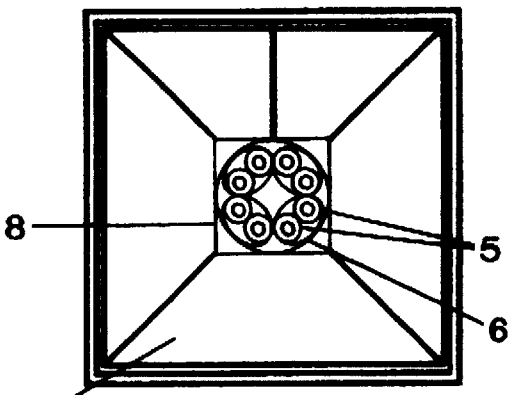
FIG. 7 shows another shield cover, adapted for an internal shield kernel and adapted to mate with a shield cover as shown in FIGS. 6A–6C.
Figure 7C:
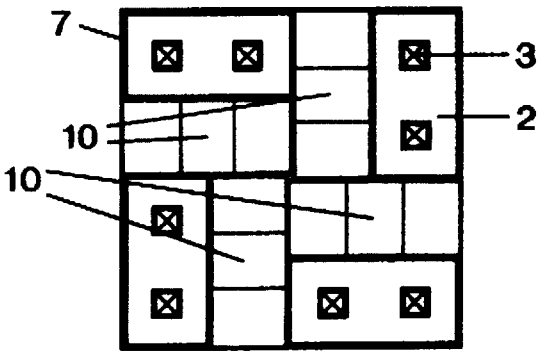
Figure 7A:
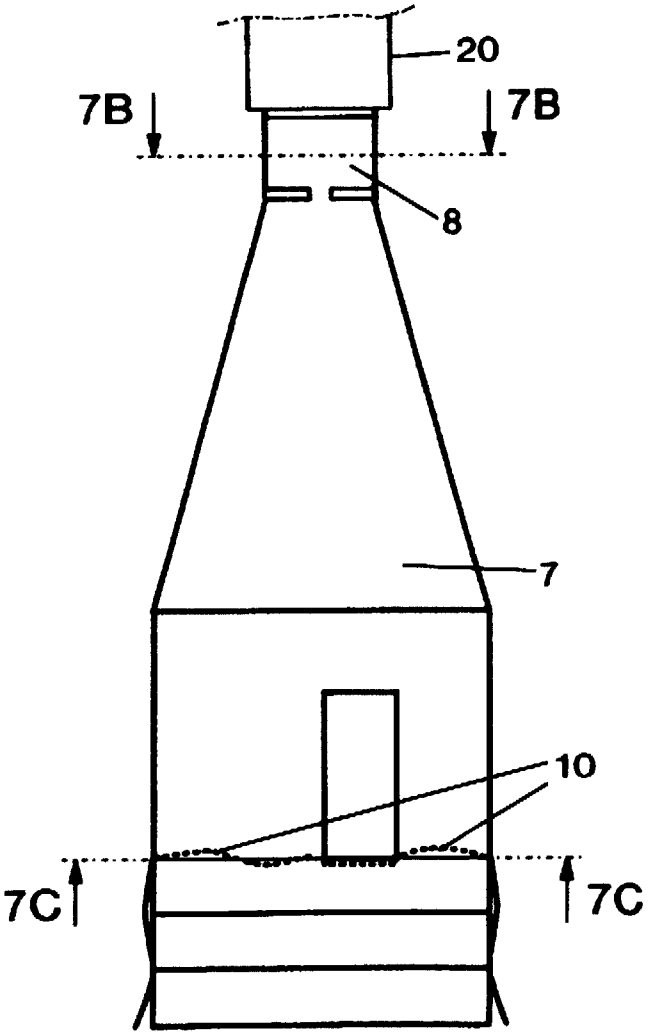

Noting that the same reference numerals are used for the same parts throughout all drawings, it is now referred to FIGS. 6 and 7: The left part of these drawings shows embodiments of shield covers 17 and 7, which two shield covers are cable connector covers, adapted to cooperate with connector inside parts as shown in FIGS. 1, 3, 4 and 5. The shield covers are typically made from 0.3 mm thick, springy metal sheets as single- or possibly two-piece units. Each shield cover 7, 17 is folded around a kernel member 1, 11, including plastic holders 2, 12 having pins/receptacles 3/13, as well as a cable. At the rear end, each shield cover has a section which is adapted as a split circular clamp 8, 18 to be crimped around the cable pairs in order to provide strain relief and electrical contact with the cable foil screens 6 and 16, Bee the top right drawing in FIGS. 6 and 7, indicating a cross section view taken at the line A—A in the left side drawing.

In the particular embodiment shown in FIGS. 6 and 7, the shield cover 7 in FIG. 7 is adapted to receive the shield cover 17 in FIG. 6 inside a forward extended part appearing below (in the drawing) the B—B line in FIG. 7. However, FIG. 6 nevertheless shows a female connector having receptacles 13, while FIG. 7 shows a male connector having contact pins 3. In another embodiment, matters may be reversed.

Thus, the forward extended part of the plug/male connector shown in FIG. 7 has a shape for receiving the other shield cover, with splits at each corner and come bending outward laterally, to act as a flexing guide for the other connector. The extension is also able to protect the protruding contact pins by providing a square "fence" around them.

A paramount feature of the invention also appears in FIG. 7, namely the metal tongues 10 which in this embodiment of the invention are provided by partly stamping or cutting a piece from each side of shield cover 7 and shaping and folding these pieces approximately 90 degrees inwards. These tongues 10 now act as contact springs against the kernel member 11 in the other connector, i.e. in a mated state. Actually, in the embodiment shown, with a kernel member in each connector, the contact springs 10 will be pinched between two kernels, providing a very good electrical contact.

The tongues/contact springs 10 constitute an important and characterizing part of the invention, since they provide a low-ohmic electrically continuous interface between (in this embodiment) the plug and jack shield kernels, or generally between the one necessary shield kernel of a cable-mounted connector and the shield system of the counterpart connector, whether it is another cable-mounted connector or a connector mounted on some other electrical system part, e.g. a printed circuit board.

In FIG. 7, the contact tongues 10 appear in the left side drawing as dotted lines, while a cross section view along line B—B, see the lower right part of FIG. 1, shows the tongues 10 substantially filling up the area between the plastic holders 2, and with bend lines indicated.

Figure 9A:
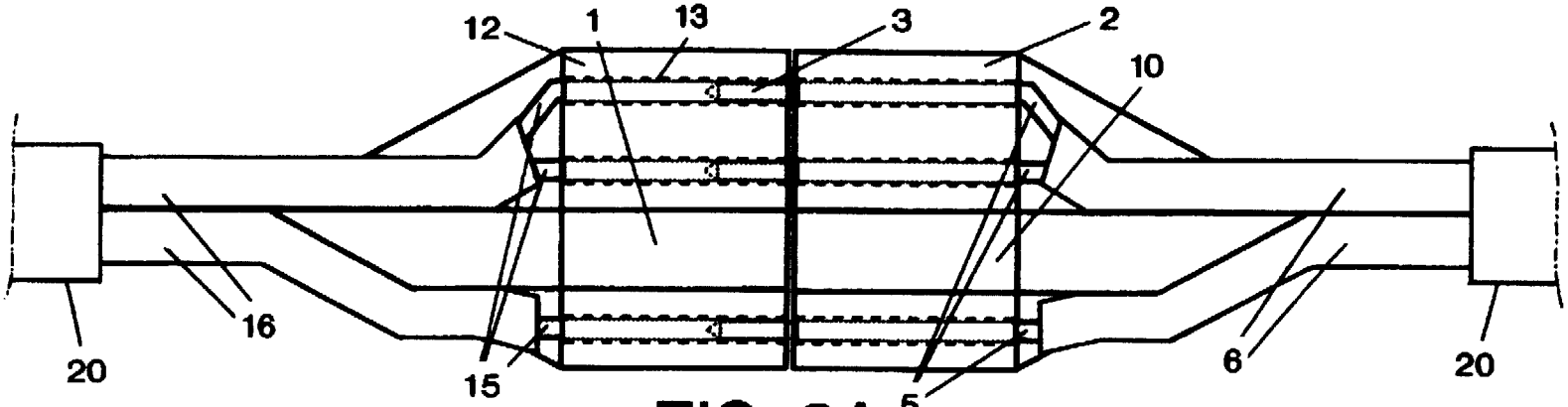
FIG. 9 shows an interconnection of male and female connectors of a cable splicing contact set according to an embodiment of the invention.
Figure 9B:
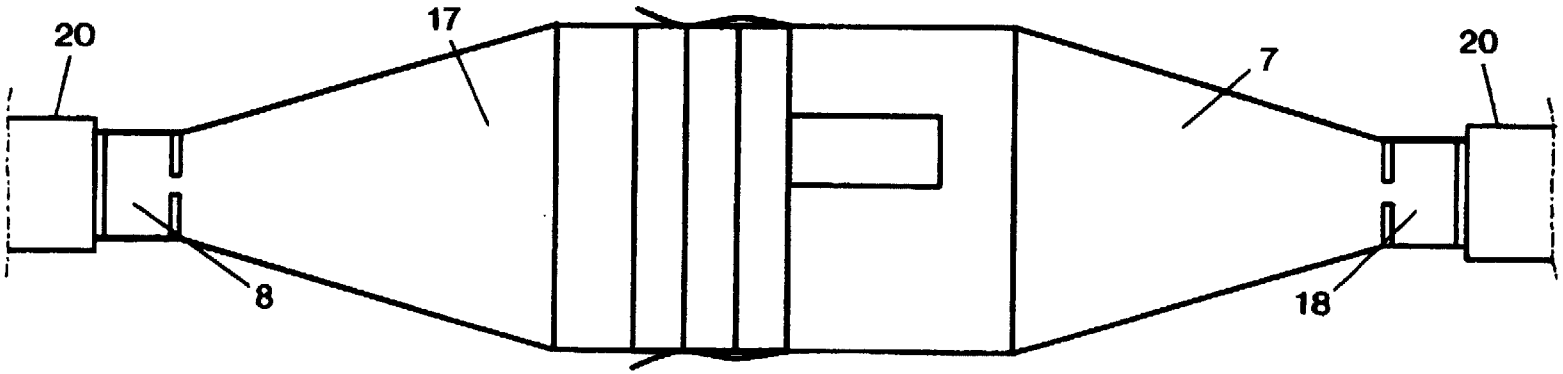
Figure 10B:
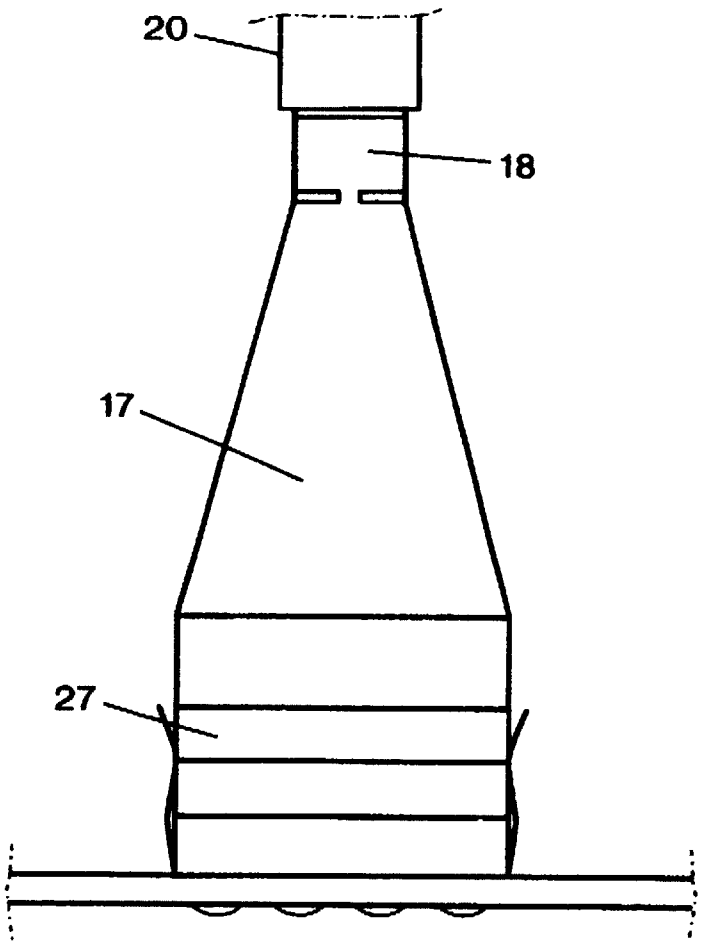
FIG. 10 shows an interconnection of a male PCB connector and a female cable connector in an embodiment of the invention.
Figure 10A:
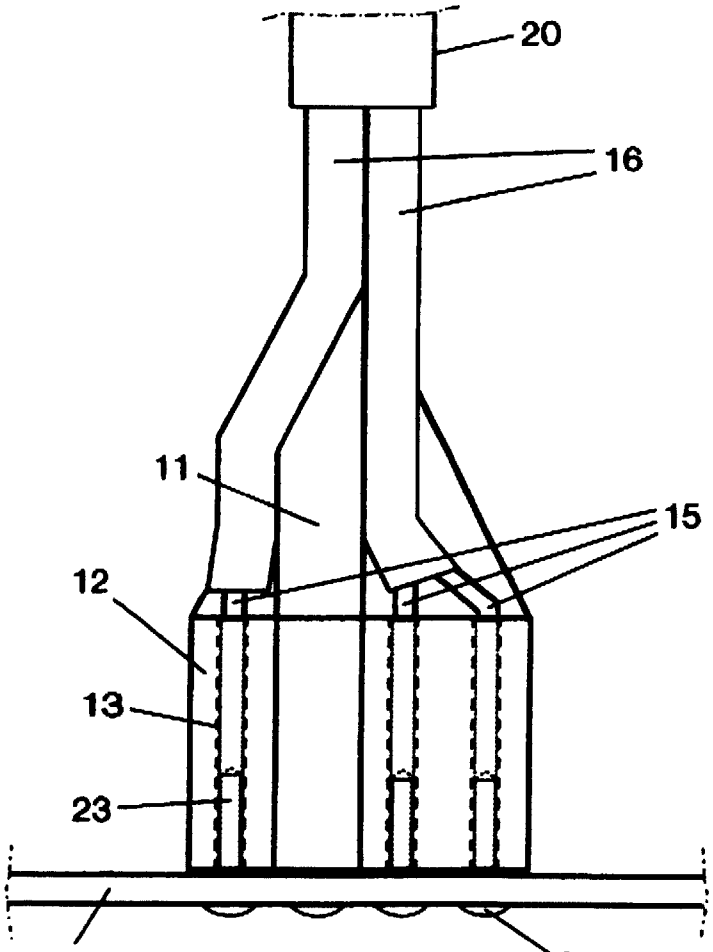
Figure 11:
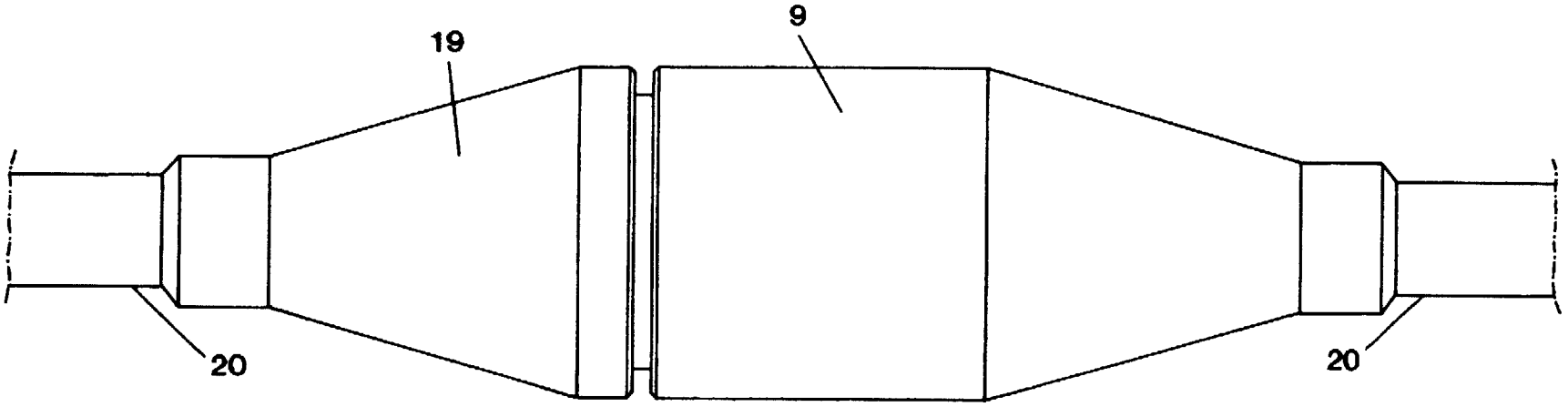
FIG. 11 shows the same as FIG. 9, however including an overall insulating cover, i.e. an embodiment of a complete cable splicing contact assembly.

FIGS. 9 to 11 show a mated state for the connectors previously shown in FIGS. 6 and 7. The top part of FIG. 9 shows an "X-ray" view through the contact set embodiment, with contact pins 3 entered properly into contact receptacles 13. The lower part of FIG. 9 shows the same situation with interconnected cable connectors, however with a view to the shield covers 7 and 17, where cover 17 has been guided into receiving cover 7. Inside and invisibly, contact springs 10 are now in a pinched situation between two shield kernels. Finally, FIG. 11 shows the interconnection of the cable plug and the cable jacket in a complete assembly where both connectors are provided with an overall insulating cover 9, 10, preferably of a plastic material. These insulating covers can be mounted e.g. by first threading a cover over the cable before assembling the connector, and thereafter pulling the cover back over the metal shield cover of the connector. Alternatively, the insulating cover 9, 19 can be moulded directly onto the connector after assembly thereof.

So far, only cable splicing embodiments have been mentioned. It is now referred to the drawings series consisting of FIGS. 2, 8, 10 and 12, which drawings concern embodiments where one connector in the contact set of the invention is a connector mounted by soldering to a printed circuit board (PCB), while the other connector is a cable-mounted connector similar to the connectors of the previously described embodiments of the invention.

Figure 2A:
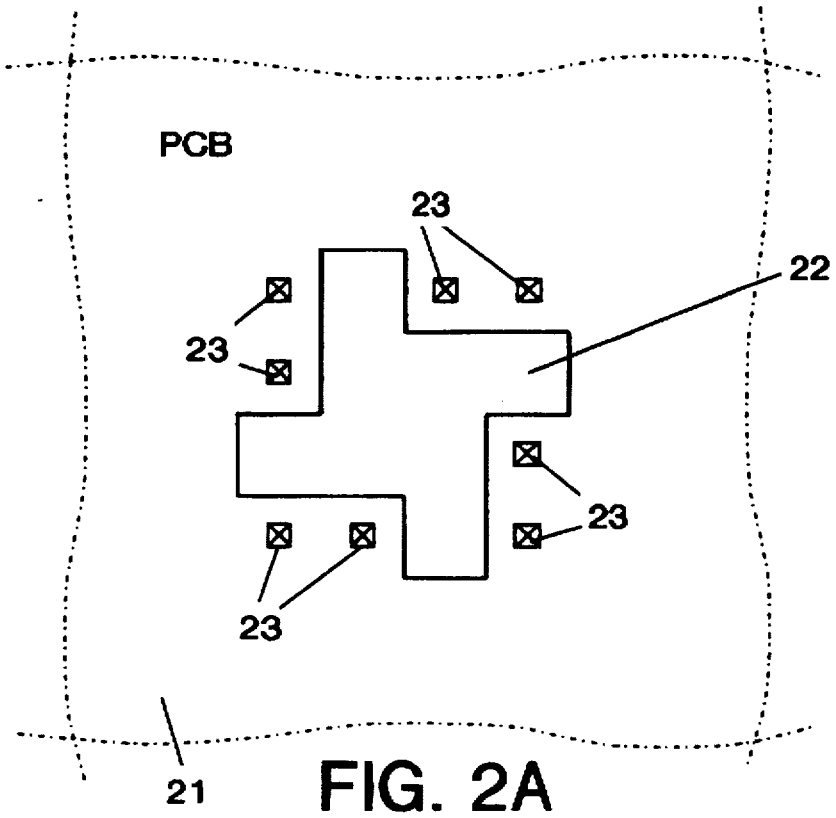
FIGS. 2A–2B show elements of a printed circuit board (PCB) embodiment of a male connector in accordance with the invention.
Figure 2B:
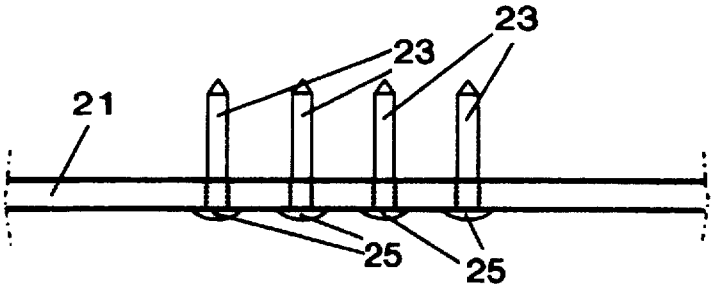
Figure 3A:
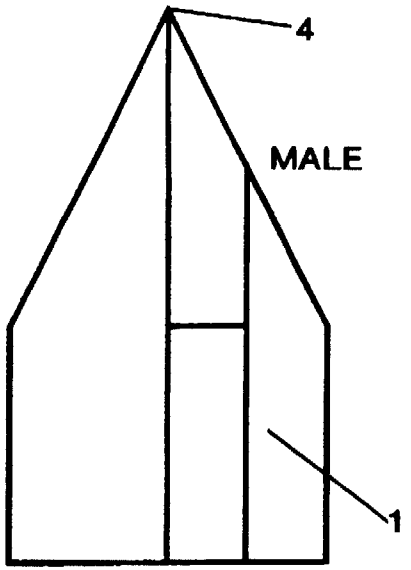
FIGS. 3A–3D show examples of shield kernels forming important parts of a cable splicing contact set embodiment of the invention.
Figure 3B:
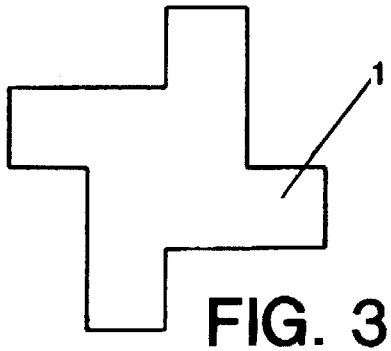
Figure 3C:
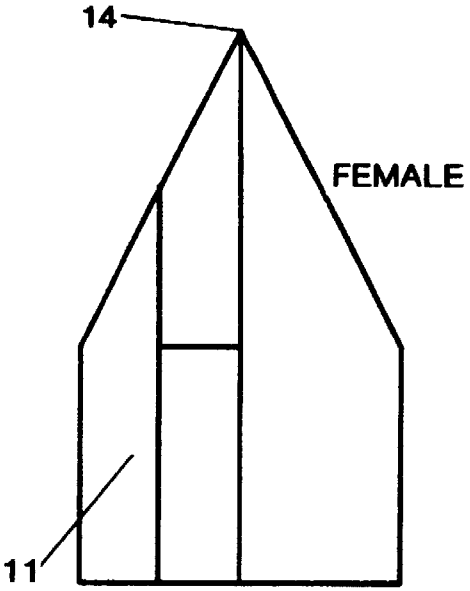
Figure 3D:
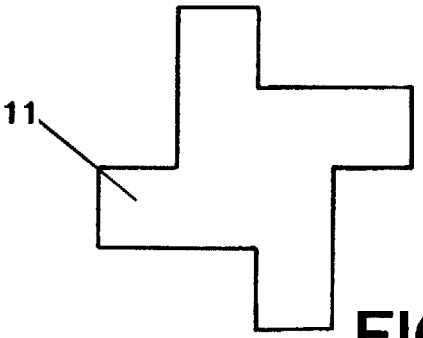
Figure 4C:
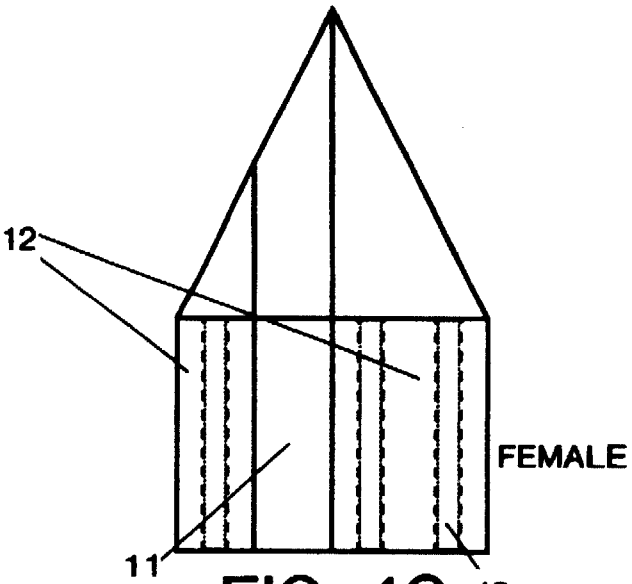
FIGS. 4A–4D show the arrangement of parts inside male and female connectors as shown in FIGS. 1A–1D and 3A–3D, FIGS. 5A–5B show attachment of cable pairs to pins/receptacles as shown in FIGS. 1A–1B, FIGS. 6A–6C show a shield cover adapted for a connector having an internal shield kernel as shown in FIGS. 3A–3D.
Figure 4D:
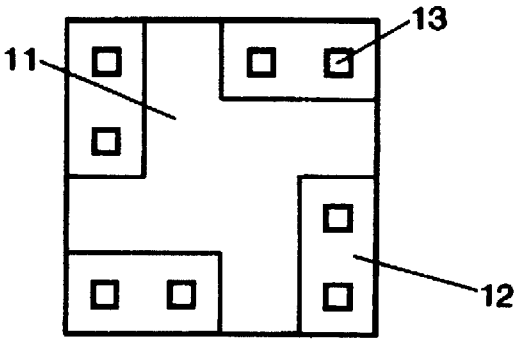
Figure 4A:
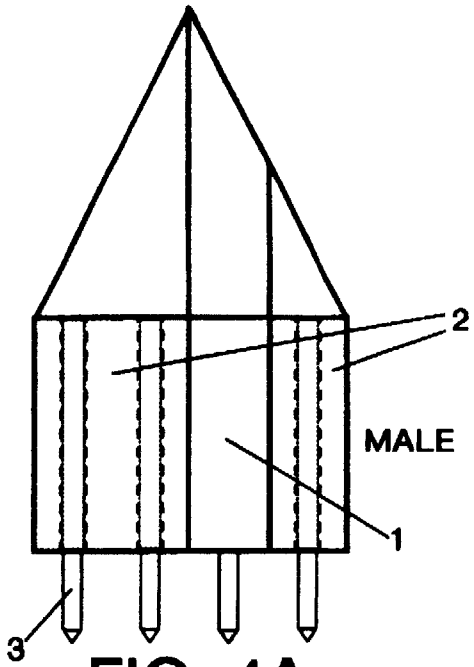
Figure 4B:
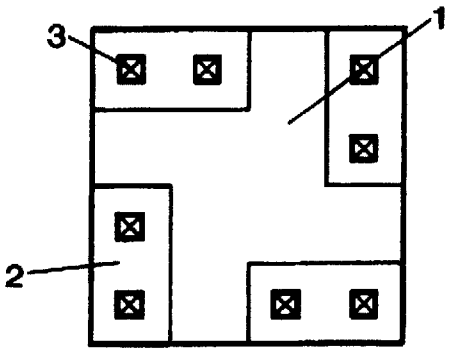

The embodiment appearing in FIGS. 2, 8, 10 and 12 is a square-shaped embodiment, however, as previously stated, this square shape is not a prerequisite. In FIG. 2 a printed circuit board 21 has soldered to it contact pins 23, however contact receptacles would be possible in the same positions. The lower part of FIG. 2 shows the PCB 21 in a side view. Reference numeral 25 designates solder points for the contact pins, which are inserted into holes in the PCB with a tight fit, and soldered to provide electrical connection to circuits on the PCB. Pin pairs use the same spacings and the same orientation relative to the nearest neighbours, as in the case with the cable-mount connectors, see the top part of FIG. 2 which is a front view. Reference numeral 22 designates a conducting ground plane on the PCB, having a specific shape designed to interface with the shield kernel of the cable mount connector to be mated with the PCB connector. This PCB connector is designed to mate with just such a connector as appears in FIG. 6, and therefore the ground plane 22 has the previously mentioned "disaligned cross" shape. However, it must be noted that metal tongues (see below) will be provided between the ground plane 22 and the mating shield kernel, to establish a springy type interface therebetween.

Figure 8A:
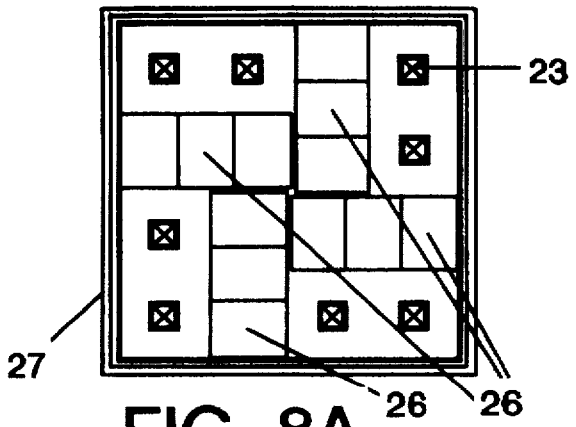
FIG. 8 shows a shield cover for a PCB connector as shown in FIG. 2.
Figure 8B:
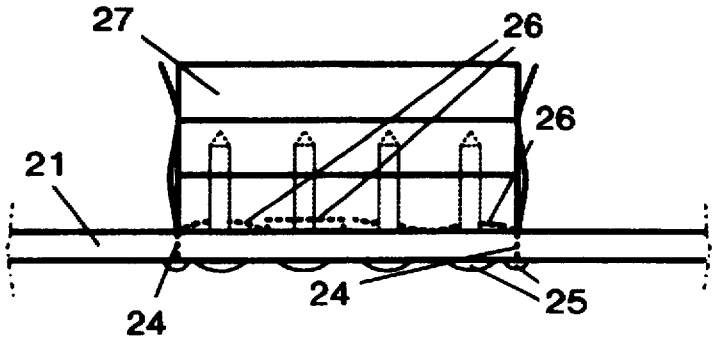

In FIG. 8 the PCB connector of FIG. 1 has had added to it a shield cover 27 made from the same material as the shield cover of the cable-mounted connectors. This shield cover 27 has a "fence" configuration around the contact pins 23, and it has partly split corners to provide a guiding function for the mating cable-mounted.connector, which in the case shown will be a female connector.

Extensions on the PCB edge of the shield cover 27 are folded inward and shaped to provide contact springs (tongues) 26 similar to the ones mentioned in the cable-mount embodiment described above. The contact springs 26 establish a low-ohmic, electrically continuous interface between the kernel member of the mating cable-mounted connector and the PCB ground plane area 22 (FIG. 2). The shield cover 27 also has soldering pins 24, shown in the lower part of FIG. 8, for soldering to the PCB 21. The contact springs 26 appear as dotted, curved lines in the lower drawing, which is a side view, and appear clearly with bend lines in the front view shown in the top drawing of fIG. 8.

Figure 12:
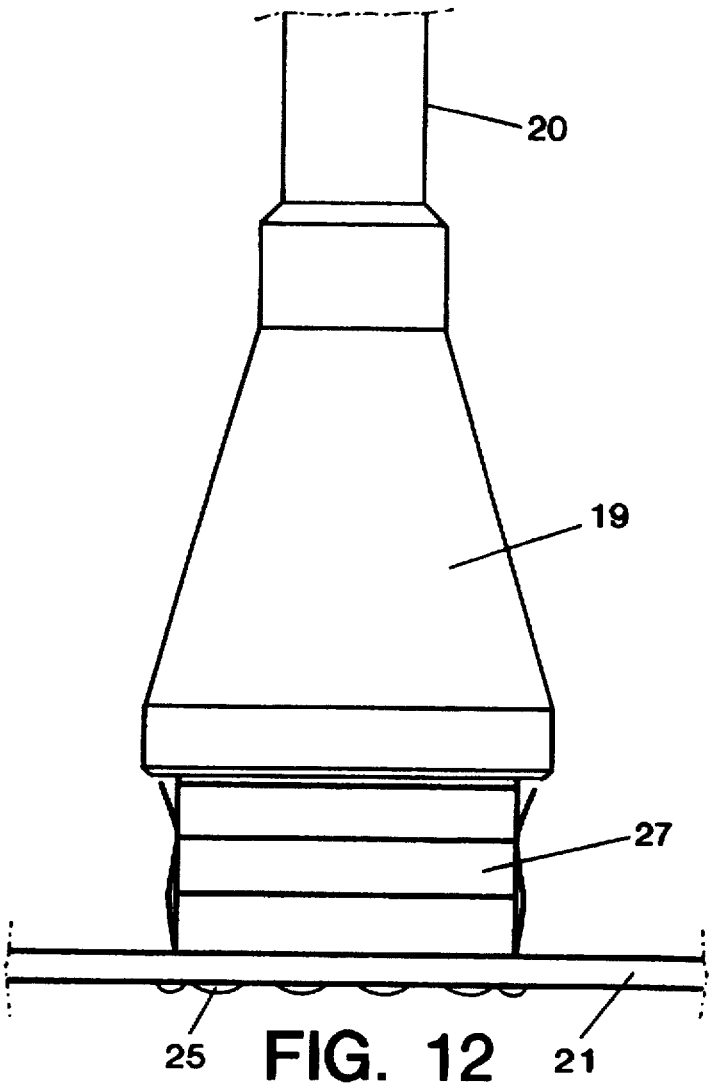
FIG. 12 shows the same as FIG. 10, where the female cable connector has an overall insulating cover.

FIGS. 10 and 12 show, in a similar manner as FIGS. 9 and 11, the interconnection of the PCB connector and the cable-mounted connector, in FIG. 10 with an "X-ray" side view in the left side part, showing contact pins 23 entered properly into contact receptacles 13 in the plastic holders 12 of the cablemounted connector.

In the right side drawing of FIG. 10 appears the same situation, but mating shield covers 17 and 27 are shown. It should be noted that the inward folded contact springs 26 in this situation are pinched between the shield kernel member 11 of the cable-mounted connector and the PCB ground plane 22 (these parts being invisible in this drawing).

Finally, FIG. 12 shows exactly the same interconnected situation, however as a complete assembly where the cable-mounted connector has been provided with an overall plastic cover 19. Usually a PCB connector will not need a similar insulating cover.

A typical dimension for a practical connector as embodied above, would be a square side edge equal to about 10 mm, while the spacing between two contact pins in a pin pair might be about 2 mm. Experiments conducted on embodiments as herein-above described, indicate that as a minimum, the electrical specifications given in the table below, will be complied with:

| Frequency | 300 MHz | 450 MHz | 600 MHz |
|---|---|---|---|
| Near End Cross Talk (NEXT) | 74 dB | 71 dB | 70 dB |
| Attenuation | 0.5 dB | 0.7 dB | 1.0 dB |
| Return Loss | 14 dB | 14 dB | 14 dB |

Finally, it should be noted that the invention also will encompass a cable splicing contact set in which only one of the connectors contains a shield kernel member, while the opposite connector does not contain such a kernel member, but is equipped with inward projecting metal tongues between the pin/receptacle pairs of this opposite connector, which opposite connector may then have a shape e.g. similar to a PCB-mounted connector as described hereabove, but with wires attached to the rear end of the pins/receptacles.

I claim:

1. A contact set for connecting a multi-pair broadband communication pair cable having individually shielded wire pairs, to a signal-forwarding part, said contact set comprising a male connector having parallel contact pins and a female connector having parallel contact receptacles adapted to be threaded directly onto said contact pins when the connectors are mated, the pins of said male connector being arranged in pairs associated with respective wire pairs in said pair cable, and the receptacles of said female connector being arranged in pairs in a corresponding manner, inside respective surrounding metal shield covers which both have an opening in a forward end for a snug fit mating with a corresponding shield cover of a connector of the opposite gender, the direction associated with the spacing between two contact pins of a pair and between two contact receptacles in a pair defining a pair orientation for each respective pair, characterized in that each pair of contact pins as well as contact receptacles is arranged, inside each respective connector, with pair orientation turned 90° in relation to the orientation of each closest pair, and with each pair arranged substantially peripherally out toward the shield cover to maximize the spacing between pairs, and that complete internal shielding between pairs of mated receptacles and pins is provided in an interconnected state of the contact set, by one of said male connector and said female connector being provided internally with a shielding kernel member of metal, arranged between all of said pairs in said one connector, and with dimensions adapted to engage directly mechanically and electrically, in an interconnected state, inward projecting metal tongues from the shield cover of the opposite contact, said tongues extending into gaps between the pairs in this opposite contact and having some bias in a direction out toward the opening of this opposite contact to form springy contact surfaces against said kernel member.

2. Contact set in accordance with claim 1, characterized in that said kernel member is shaped in such a manner that in an area behind said pairs it is tapered rearwardly to a pyramidal point, to provide slanted guidance and support paths for each wire pair in a pair cable forward to each said pair, each single wire being attached to a rear end of a single receptacle and pin by means of one connection form among the group consisting of solder connection, crimp connection and displacement connection.

3. Contact set in accordance with claim 2, characterized in that the shield cover of the connector having said kernel member, is shape-adapted thereto in order to press each wire pair, which is surrounded by a metal foil, into good contact with said kernel member along substantially the whole guidance and support path.

4. Contact set in accordance with claim 3, characterized in that each said pair in the connector having a kernel member, is mounted in and through a respective separate, insulating holder part, and that the outer cross section shape of the kernel member perpendicularly to the longitudinal direction of said pins and receptacles, is adapted to be substantially complementary to the cross section of the holder parts in such a manner that the inner cross section of the shield cover in an area around said holder parts is filled, whereby a mechanically stable construction is achieved.

5. Contact set in accordance with claim 4, adapted to a four-pair cable, characterized in that the cross section of each shield cover in the area having pins and receptacles is square-shaped, that the cross section of each holder part is substantially rectangular, said holder parts being positioned in corners of said square-shaped cross section, and that each inwardly projecting tongue has a width which is substantially equal to the spacing between two neighbouring holder parts and a length equal to one half square side, so that said tongues together cover approximately the whole cross section area between said holder parts, which area corresponds to a forward cross section area and a front area of said kernel member.

6. Contact set in accordance with claim 5, in which said signal-forwarding part is a similar pair cable, characterized in that said opposite connector also has a similar shield kernel member and holder parts, that said metal tongues are folded in from partially stamped-out areas of the shield cover of this opposite connector, that the shield cover of this opposite connector has an extended dimension in a forward direction, while on its forward edge being provided with a number of slits, preferably in corners, and being a little expanded in its forward end to facilitate reception of said one of the male and female connectors, that the contact pins project out of and forward from their holder parts with a sufficient length to enter said receptacles properly without reaching the bottom thereof, and that length dimensions of said two kernel members are adjusted so that said metal tongues are pinched between said two kernel members when the connectors are completely interconnected.

7. Contact set in accordance with claim 5, in which the signal-forwarding part is a printed circuit board, characterized in that said pairs in said opposite connector are soldered to conductive paths on the circuit board so as to project forward from pre-drilled, adapted holes in said circuit board, that the shield cover of said opposite connector is equipped in its rear edge with solder legs soldered to conductive paths on said circuit board, in positions surrounding said holes, and that said inward projecting tongues are constituted by inwardly folded extensions of the shield cover of said opposite connector, and are situated substantially right in front of said circuit board.

8. Contact set in accordance with claim 7, characterized in that a conducting ground plane is provided on said circuit board just behind said inward projecting tongues and having substantially the same shape as said cross section area.

9. Contact set in accordance with claim 8, characterized in that the shield cover of the board-mounted opposite connector on its forward edge is provided with a number of slits, preferably in corners, and is expanded somewhat in its forward end to facilitate reception of said one of the male and female connectors.

10. Contact set in accordance with claim 8, characterized in that said pairs in said boardmounted opposite connector are contact pin pairs.

11. Contact set in accordance with claim 1, characterized in that said kernel member is constructed as a solid metal block.

12. Contact set in accordance with claim 1, characterized in that each connector having a kernel member has an electrically insulating cover surrounding a rear section of said shield cover, including an aperture section of said shield cover, intended for entering said pair cable into the connector.

13. Contact set in accordance with claim 12, characterized in that said shield cover adjacent to said aperture section is provided with a cable clamping section.

14. Male connector, characterized in that it is a circuit board mounted connector having contact pins and being constructed in accordance with the features included in claim 10 for such a connector.

15. Female connector, characterized in that it is a circuit board mounted connector having contact receptacles and being constructed in accordance with the features included in claim 8 for such a connector.

16. Female connector, characterized in that it is a cable-mounted connector having contact receptacles and metal tongues and being constructed in accordance with the features included in claim 6 for such a female connector.

17. Male connector, characterized in that it is a cable-mounted connector having contact pins and holder parts, and being constructed in accordance wish the features included in claim 6 for such a male connector.

18. Female connector, characterized in that it is a cable-mounted connector having contact receptacles and holder parts, and being constructed in accordance with the features included in claim 6 for such a female connector.

19. Male connector, characterized in that it is a cable-mounted connector having contact pins and metal tongues, and being constructed in accordance wih the features included in claim 6 for such a male connector.

20. Contact set in accordance with claim 6, characterized in that each connector having a kernel member has an electrically insulating cover surrounding a rear section of said shield cover, including an aperture section of said shield cover, intended for entering said pair cable into the connector.

* * * * *